US006858570B2

(12) United States Patent
Lang et al.

(10) Patent No.: US 6,858,570 B2
(45) Date of Patent: Feb. 22, 2005

(54) LAUNDRY DETERGENTS AND LAUNDRY TREATMENT COMPOSITIONS COMPRISING ONE OR MORE DYE-TRANSFER-INHIBITING DYE FIXATIVES

(75) Inventors: Frank-Peter Lang, Hattersheim (DE); Helmut Berenbold, Wiesbaden (DE); Michael Wessling, Ober-Olm (DE)

(73) Assignee: Clariant GmbH, Frankfurt (DE)

( * ) Notice: Subject to any disclaimer, the term of this patent is extended or adjusted under 35 U.S.C. 154(b) by 282 days.

(21) Appl. No.: 10/085,712

(22) Filed: Feb. 28, 2002

(65) Prior Publication Data

US 2003/0171249 A1 Sep. 11, 2003

(30) Foreign Application Priority Data

Mar. 3, 2001 (DE) ..... 101 10 338

(51) Int. Cl.[7] ..... C11D 1/38; C11D 1/94; C11D 3/30; C11D 3/386; C11D 3/395

(52) U.S. Cl. ..... 510/302; 510/303; 510/320; 510/321; 510/336; 510/351; 510/356; 510/475; 510/499

(58) Field of Search ..... 510/292, 302, 510/303, 320, 321, 336, 337, 351, 356, 475, 499, 357

(56) References Cited

U.S. PATENT DOCUMENTS

| | | | | |
|---|---|---|---|---|
| 3,128,287 | A | 4/1964 | Berg | |
| 3,159,581 | A | 12/1964 | Diehl | |
| 3,213,030 | A | 10/1965 | Diehl | |
| 3,332,880 | A | 7/1967 | Kessler et al. | |
| 3,400,148 | A | 9/1968 | Quimby et al. | |
| 3,422,021 | A | 1/1969 | Roy | |
| 3,422,137 | A | 1/1969 | Quimby | |
| 3,635,830 | A | 1/1972 | Lamberti et al. | |
| 3,936,537 | A | 2/1976 | Baskerville, Jr. et al. | |
| 3,985,669 | A | 10/1976 | Krummel et al. | |
| 4,166,845 | A | 9/1979 | Hansen et al. | 424/78 |
| 4,374,035 | A | 2/1983 | Bossu | |
| 4,412,934 | A | 11/1983 | Chung et al. | |
| 4,536,314 | A | 8/1985 | Hardy et al. | |
| 4,539,130 | A | 9/1985 | Thompson et al. | |
| 4,566,984 | A | 1/1986 | Bush | |
| 4,605,509 | A | 8/1986 | Corkill et al. | |
| 4,606,838 | A | 8/1986 | Burns | |
| 4,634,544 | A | 1/1987 | Weber et al. | 252/99 |
| 4,634,551 | A | 1/1987 | Burns et al. | |
| 4,663,071 | A | 5/1987 | Bush et al. | |
| 4,664,839 | A | 5/1987 | Rieck | |
| 4,671,891 | A | 6/1987 | Hartman | |
| 4,681,592 | A | 7/1987 | Hardy et al. | |
| 4,681,695 | A | 7/1987 | Divo | |
| 4,686,063 | A | 8/1987 | Burns | |
| 5,372,747 | A | 12/1994 | Uhrig et al. | |
| 6,008,316 | A | 12/1999 | Foster, Jr. et al. | |
| 6,025,322 | A | 2/2000 | Boeckh et al. | 510/516 |
| 6,596,678 | B2 * | 7/2003 | Panandiker et al. | 510/303 |
| 2004/0023836 | A1 * | 2/2004 | Moorfield et al. | 510/475 |

FOREIGN PATENT DOCUMENTS

| | | |
|---|---|---|
| EP | 0 341 205 | 11/1989 |
| EP | 0 341 593 | 11/1989 |
| EP | 0 384 070 | 8/1990 |
| EP | 0 462 806 | 12/1991 |
| EP | 0 811 679 | 12/1997 |
| EP | 0 841 391 | 5/1998 |
| EP | 0 854 136 | 7/1998 |
| EP | 0 949 861 | 2/2000 |
| EP | 0 978 556 | 2/2000 |
| EP | 1 020 513 | 7/2000 |
| GB | 1082179 | 9/1967 |
| WO | 97/42287 | 11/1997 |
| WO | 98/12296 | 3/1998 |
| WO | WO 98/29530 | 7/1998 |
| WO | 98/38276 | 9/1998 |
| WO | WO 00/56848 | 9/2000 |
| WO | 01/00767 | 1/2001 |
| WO | WO 01/59054 | 8/2001 |

OTHER PUBLICATIONS

U.S. Provisional application No. 60/202,623.*

W. Stein, et al., "α–Sulfonated Fatty Acids and Ester: Manufacturing Process, Properties, and Applications", The Journal of the American Oil Chemists Society, 52 (1975), p. 323–329.

U.S. Appl. No. 10/085,997, filed Feb. 28, 2002, Lang et al.

* cited by examiner

*Primary Examiner*—Gregory R. Del Cotto
(74) *Attorney, Agent, or Firm*—Richard P. Silverman

(57) ABSTRACT

The following dye-transfer-inhibiting dye fixatives are used in laundry detergents:

Reaction products of a) polyamines with cyanamides and amidosulfuric acid or b) cyanamides with aldehydes and ammonium salts or c) amines with epichlorohydrin.

11 Claims, No Drawings

LAUNDRY DETERGENTS AND LAUNDRY TREATMENT COMPOSITIONS COMPRISING ONE OR MORE DYE-TRANSFER-INHIBITING DYE FIXATIVES

The invention relates to laundry detergents and laundry treatment compositions comprising dye-transfer-inhibiting dye fixatives, where these dye fixatives are obtained by reacting a) polyamines with cyanamides and amidosulfuric acid or b) cyanamides with aldehydes and ammonium salts or c) amines with epichlorohydrin.

The amines used can be primary, secondary and tertiary amines. They may be aliphatic amines, alicyclic amines, such as, for example, cyclohexylamine, and aromatic amines, such as, for example, aniline. The amines used can, however, also have aliphatic, alicyclic and aromatic substituents at the same time. In addition, it is also possible to use heterocyclic compounds, such as, for example, pyridine.

The term polyamines includes here, for example, diamines, triamines, tetramines etc.

Examples thereof are ethylenediamine, propylenediamine, butylenediamine, pentylenediamine, hexylenediamine, diethylenetriamine, triethylenetetramine and higher polyamines. Particular preference is given to diethylenetriamine.

The ammonium salts may be salts of ammonia or of the abovementioned amines and polyamines with various inorganic or organic acids, or else quaternary ammonium salts.

The cyanamides may be cyanamide or dicyanodiamide. Aldehydes which can be used for the synthesis of the dye-transfer-inhibiting dye fixatives are, for example, aliphatic aldehydes, such as, for example, formaldehyde, acetaldehyde, propionaldehyde, butyraldehyde; dialdehydes, such as, for example, glyoxal; unsaturated aldehydes, such as, for example, acrolein, crotonaldehyde and aromatic aldehydes, such as, for example, benzaldehyde. Particular preference is given to aliphatic aldehydes.

These dye fixatives are added to the laundry detergents according to the invention in order to improve the washfastness of the textile dyes by reducing the bleeding thereof.

These dye fixatives also have a dye-transfer-inhibiting action at the same time by binding residual amounts of bled dye in the wash liquor in the case of very poor washfastnesses of the dyed textiles, thus preventing deposition on white fabric or fabric of a different dye washed therewith.

The laundry detergent formulations in which the dye-transfer-inhibiting dye fixatives described can be used are pulverulent, granular, paste, gellike or liquid. Examples thereof are heavy-duty detergents, light-duty detergents, dye detergents, wool detergents, drape detergents, modular detergents, washing tablets, bar soaps, detergent formulations packaged in water-soluble films and stain-removal salts. Laundry treatment compositions are, for example, laundry starches and stiffening agents, and also ironing aids.

In addition, said dye-transfer-inhibiting dye fixatives can be used in laundry pre-treatment and laundry after-treatment compositions, which can be used before or after the actual washing operation and which serve exclusively to care and condition laundry, but not to clean laundry.

The laundry detergents according to the invention comprise at least 0.1%, preferably between 0.1 and 10% and particularly preferably 0.5 to 5% of the dye-transfer-inhibiting dye fixatives described.

Formulations which are used as laundry pre-treatment and/or after-treatment compositions can comprise between 1 and 99% of the dye fixatives.

Depending on their intended use, the composition of the formulations is adapted to the type of textiles to be washed.

They comprise conventional laundry detergent and cleaning composition ingredients, as in the prior art. Representative examples of such laundry detergent and cleaning composition ingredients are described below.

The overall concentration of the surfactants in the finished laundry detergent formulation can be from 1 to 99% and preferably from 5 to 80% (all % by weight).

The surfactants used may be anionic, nonionic, amphoteric and cationic. It is also possible to use mixtures of said surfactants. Preferred laundry detergent formulations comprise anionic and/or nonionic surfactants and mixtures thereof with other surfactants.

Suitable anionic surfactants are sulfates, sulfonates, carboxylates, phosphates and mixtures thereof. Suitable cations here are alkali metals, such as, for example, sodium or potassium or alkaline earth metals, such as, for example, calcium or magnesium, and ammonium, substituted ammonium compounds, including mono-, di- or triethanolammonium cations, and mixtures thereof.

The following types of anionic surfactants are particularly preferred: alkyl ester sulfonates, alkyl sulfates, alkyl ether sulfates, alkylbenzenesulfonates, alkanesulfonates and soaps, as described below.

Alkyl ester sulfonates are, inter alia, linear esters of $C_8$–$C_{20}$-carboxylic acids (i.e. fatty acids), which are sulfonated by means of gaseous $SO_3$, as described in "The Journal of the American Oil Chemists Society" 52 (1975), pp. 323–329. Suitable starting materials are natural fats, such as, for example, tallow, coconut oil and palm oil, but can also be synthetic in nature.

Preferred alkyl ester sulfonates, specifically for laundry detergent applications, are compounds of the formula

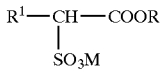

in which $R^1$ is a $C_8$–$C_{20}$-hydrocarbon radical, preferably alkyl, and R is a $C_1$–$C_6$ hydrocarbon radical, preferably alkyl. M is a cation which forms a water-soluble salt with the alkyl ester sulfonate. Suitable cations are sodium, potassium, lithium or ammonium cations, such as monoethanolamine, diethanolamine and triethanolamine. Preferably, $R^1$ is $C_{10}$–$C_{16}$-alkyl and R is methyl, ethyl or isopropyl. Particular preference is given to methyl ester sulfonates in which $R^1$ is $C_{10}$–$C_{16}$-alkyl.

Alkyl sulfates are here water-soluble salts or acids of the formula $ROSO_3M$ in which R is a $C_{10}$–$C_{24}$-hydrocarbon radical, preferably an alkyl or hydroxyalkyl radical with $C_{10}$–$C_{20}$-alkyl components, particularly preferably a $C_{12}$–$C_{18}$ alkyl or hydroxyalkyl radical. M is hydrogen or a cation, e.g. an alkali metal cation (e.g. sodium, potassium, lithium) or ammonium or substituted ammonium, e.g. methyl-, dimethyl- and trimethylammonium cations and quaternary ammonium cations, such as tetramethylammonium and dimethylpiperidinium cations and quaternary ammonium cations, derived from alkylamines, such as ethylamine, diethylamine, triethylamine and mixtures thereof. Alkyl chains with $C_{12}$–$C_{16}$ are preferred for low washing temperatures (e.g. below about 50° C.) and alkyl chains with $C_{16}$–$C_{18}$ are preferred for higher washing temperatures (e.g. above about 50° C.).

Alkyl ether sulfates are water-soluble salts or acids of the formula $RO(A)_m\ SO_3M$, in which R is an unsubstituted $C_{10}$–$C_{24}$-alkyl or hydroxyalkyl radical, preferably a $C_{12}$–$C_{20}$-alkyl or hydroxyalkyl radical, particularly preferably $C_{12}$–$C_{18}$-alkyl or hydroxyalkyl radical. A is an ethoxy or propoxy unit, m is a number greater than 0, preferably between about 0.5 and about 6, particularly preferably between about 0.5 and about 3, and M is a hydrogen atom or a cation, such as, for example, sodium, potassium, lithium, calcium, magnesium, ammonium or a substituted ammonium cation. Specific examples of substituted ammonium cations are methyl-, dimethyl-, trimethylammonium and quaternary ammonium cations, such as tetramethylammonium and dimethylpiperidinium cations, and also those derived from alkylamines, such as ethylamine, diethylamine, triethylamine or mixtures thereof. Examples which may be mentioned are $C_{12}$- to $C_{18}$-fatty alcohol ether sulfates where the content of EO is 1, 2, 2.5, 3 or 4 mol per mole of fatty alcohol ether sulfate, and in which M is sodium or potassium.

In secondary alkanesulfonates, the alkyl group can either be saturated or unsaturated, branched or linear and optionally substituted by a hydroxyl group. The sulfo group can be at any desired position on the carbon chain, the primary methyl groups at the start of the chain and at the end of the chain having no sulfonate groups. The preferred secondary alkanesulfonates contain linear alkyl chains having about 9 to 25 carbon atoms, preferably about 10 to about 20 carbon atoms and particularly preferably about 13 to 17 carbon atoms. The cation is, for example, sodium, potassium, ammonium, mono-, di- or triethanolammonium, calcium or magnesium, and mixtures thereof. Sodium is preferred as cation.

In addition to secondary alkanesulfonates, it is also possible to use primary alkanesulfonates in the laundry detergents according to the invention.

The preferred alkyl chains and cations correspond to those of the secondary alkanesulfonates.

The preparation of primary alkanesulfonic acid, from which the corresponding sulfonates effective as surfactant are obtained is described, for example, in EP 854 136-A1.

Further suitable anionic surfactants are alkenyl- or alkylbenzenesulfonates. The alkenyl or alkyl group can be branched or linear and may be optionally substituted by a hydroxyl group. The preferred alkylbenzenesulfonates contain linear alkyl chains having about 9 to 25 carbon atoms, preferably from about 10 to about 13 carbon atoms, the cation is sodium, potassium, ammonium, mono-, di- or triethanolammonium, calcium or magnesium and mixtures thereof.

For mild surfactant systems, magnesium is preferred as cation, whereas for standard detergent applications, sodium is preferred. The same applies to alkenylbenzenesulfonates.

The term anionic surfactant also covers olefinsulfonates which are obtained by sulfonation of $C_8$–$C_{24}$-, preferably $C_{14}$–$C_{16}$-α-olefins with sulfur trioxide and subsequent neutralization. As a result of the preparation process, these olefinsulfonates may comprise relatively small amounts of hydroxyalkanesulfonates and alkanedisulfonates. Specific mixtures of α-olefinsulfonates are described in U.S. Pat. No. 3,332,880.

Further preferred anionic surfactants are carboxylates, e.g. fatty acid soaps and comparable surfactants. The soaps may be saturated or unsaturated and can contain various substituents, such as hydroxyl groups or α-sulfonate groups. Preference is given to linear saturated or unsaturated hydrocarbon radicals as hydrophobic moiety with about 6 to about 30, preferably about 10 to about 18, carbon atoms.

Suitable anionic surfactants are also salts of acylaminocarboxylic acids, the acyl sarcosinates which form by reacting fatty acid chlorides with sodium sarcosinate in an alkaline medium; fatty acid-protein condensation products, which are obtained by reacting fatty acid chlorides with oligopeptides; salts of alkylsulfamidocarboxylic acid; salts of alkyl- and alkylaryl ether carboxylic acids; sulfonated polycarboxylic acids prepared by sulfonation of the pyrolysis products of alkaline earth metal citrates, as described, for example, in GB-1,082,179; alkyl- and alkenylglycerol sulfates, such as oleylglycerol sulfates, alkylphenol ether sulfates, alkyl phosphates, alkyl ether phosphates, isethionates, such as acyl isethionates, N-acyltaurides, alkyl succinates, sulfosuccinates, monoesters of sulfosuccinates (particularly saturated and unsaturated $C_{12}$–$C_{18}$-monoesters) and diesters of sulfosuccinates (particularly saturated and unsaturated $C_{12}$–$C_{18}$-diesters), acyl sarcosinates, sulfates of alkyl polysaccharides, such as sulfates of alkyl polyglycosides, branched primary alkyl sulfates and alkylpolyethoxycarboxylates, such as those of the formula $RO(CH_2CH_2)_kCH_2COO^-M^+$, in which R is $C_8$ to $C_{22}$-alkyl, k is a number from 0 to 10 and M is a cation.

Further examples are described in "Surface Active Agents and Detergents" (Vol. I and II, Schwartz, Perry and Berch).

Examples of suitable nonionic surfactants are the following compounds:

condensation products of aliphatic alcohols with about 1 to about 25 mol of ethylene oxide.

The alkyl chain of the aliphatic alcohols can be linear or branched, primary or secondary and generally comprises about 8 to about 22 carbon atoms. Particular preference is given to the condensation products of $C_{10}$- to $C_{20}$-alcohols with about 2 to about 18 mol of ethylene oxide per mole of alcohol. The alkyl chain can be saturated or else unsaturated. The alcohol ethoxylates may have a narrow homolog distribution of the ethylene oxide ("narrow range ethoxylates") or a broad homolog distribution of the ethylene oxide ("broad range ethoxylates"). Examples of commercially available nonionic surfactants of this type are Tergitol® 15-S-9 (condensation product of a linear secondary $C_{11}$–$C_{15}$-alcohol with 9 mol of ethylene oxide), Tergitol® 24-L-NMW (condensation product of a linear primary $C_{12}$–$C_{14}$-alcohol with 6 mol of ethylene oxide in the case of a narrow molecular weight distribution). This class of product also includes the Genapol® grades from Clariant GmbH.

Condensation products of ethylene oxide with a hydrophobic base, formed by condensation of propylene oxide with propylene glycol.

The hydrophobic moiety of these compounds preferably has a molecular weight between about 1500 and about 1800. The addition of ethylene oxide onto this hydrophobic moiety leads to an improvement in the solubility in water. The product is liquid up to a polyoxyethylene content of about 50% of the total weight of the condensation product, which corresponds to a condensation with up to about 40 mol of ethylene oxide. Commercially available examples of this class of product are the Pluronic® grades from BASF and the ®Genapol PF grades from Clariant GmbH.

Condensation products of ethylene oxide with a reaction product of propylene oxide and ethylenediamine.

The hydrophobic moiety of these compounds consists of the reaction product of ethylenediamine with excess propylene oxide and generally has a molecular weight of about 2500 to 3000. Ethylene oxide is added onto this hydrophobic moiety up to a content of about 40 to about 80% by weight of polyoxyethylene and a molecular weight of about 5000 to 11000. Commercially available examples of this class of compound are the ®Tetronic grades from BASF and the ®Genapol PN grades from Clariant GmbH.

Semipolar Nonionic Surfactants

This category of nonionic compounds includes water-soluble amine oxides, water-soluble phosphine oxides and water-soluble sulfoxides, each having an alkyl radical of from about 10 to about 18 carbon atoms. Semipolar nonionic surfactants are also amine oxides of the formula

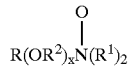

R is here an alkyl, hydroxyalkyl or alkylphenol group with a chain length of from about 8 to about 22 carbon atoms, $R^2$ is an alkylene or hydroxylalkylene group having about 2 to 3 carbon atoms or mixtures thereof, each radical $R^1$ is an alkyl or hydroxyalkyl group having about 1 to about 3 carbon atoms or a polyethylene oxide group having about 1 to about 3 ethylene oxide units, and x is a number from 0 to about 10. The $R^1$ groups can be joined together via an oxygen or nitrogen atom, thus forming a ring. Amine oxides of this type are, in particular, $C_{10}$–$C_{18}$-alkyldimethylamine oxides and $C_8$–$C_{12}$-alkoxyethyldihydroxyethylamine oxides.

Fatty Acid Amides

Fatty acid amides have the formula

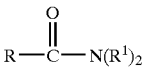

in which R is an alkyl group having about 7 to about 21, preferably about 9 to about 17, carbon atoms, and each radical $R^1$ is hydrogen, $C_1$–$C_4$-alkyl, $C_1$–$C_4$-hydroxyalkyl or $(C_2H_4O)_xH$, where x varies from about 1 to about 3. Preference is given to $C_8$–$C_{20}$-amides, -monoethanolamides, -diethanolamides and -isopropanolamides.

Further suitable nonionic surfactants are alkyl and alkenyl oligoglycosides, and fatty acid polyglycol esters or fatty amine polyglycol esters having 8 to 20, preferably 12 to 18, carbon atoms in the fatty alkyl radical, alkoxylated triglycamides, mixed ethers or mixed formals, alkyl oligoglycosides, alkenyl oligoglycosides, fatty acid N-alkyl glucamides, phosphine oxides, dialkyl sulfoxides and protein hydrolysates.

Polyethylene, polypropylene and polybutylene oxide condensates of alkylphenols.

These compounds include the condensation products of alkylphenols with a $C_6$- to $C_{20}$-alkyl group, which may either be linear or branched, with alkene oxides. Preference is given to compounds having about 5 to 25 mol of alkene oxide per mole of alkylphenol. Commercially available surfactants of this type are, for example, Igepal® CO-630, Triton® X-45, X-114, X-100 and X102, and the ®Arkopal-N grades from Clariant GmbH. These surfactants are referred to as alkylphenol alkoxylates, e.g. alkylphenol ethoxylates.

Typical examples of amphoteric or zwitterionic surfactants are alkylbetaines, alkylamidobetaines, aminopropionates, aminoglycinates or amphoteric imidazolinium compounds of the formula

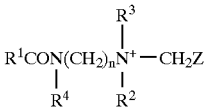

in which $R^1$ is $C_8$–$C_{22}$-alkyl or -alkenyl, $R^2$ is hydrogen or $CH_2CO_2M$, $R^3$ is $CH_2CH_2OH$ or $CH_2CH_2OCH_2CH_2CO_2M$, $R^4$ is hydrogen, $CH_2CH_2OH$ or $CH_2CH_2COOM$, Z is $CO_2M$ or $CH_2CO_2M$, n is 2 or 3, preferably 2, M is hydrogen or a cation, such as alkali metal, alkaline earth metal, ammonium or alkanolammonium.

Preferred amphoteric surfactants of this formula are monocarboxylates and dicarboxylates. Examples thereof are cocoamphocarboxypropionate, cocoamidocarboxypropionic acid, cocoamphocarboxyglycinate (also referred to as cocoamphodiacetate) and cocoamphoacetate.

Further preferred amphoteric surfactants are alkyldimethylbetaines and alkyldipolyethoxybetaines with an alkyl radical having about 8 to about 22 carbon atoms, which may be linear or branched, preferably having 8 to 18 carbon atoms and particularly preferably having about 12 to about 18 carbon atoms. These compounds are marketed, for example, by Clariant GmbH under the trade name ®Genagen LAB.

Suitable cationic surfactants are substituted or unsubstituted straight-chain or branched quaternary ammonium salts of the type $R^1N(CH_3)_3{}^{\rho}X^{\sigma}$, $R^1R^2N(CH_3)_2{}^{\rho}X^{\sigma}$, $R^1R^2R^3N(CH_3)^{\rho}X^{\sigma}$ or or $R^1R^2R^3R^4N^{\rho}X^{\sigma}$. The radicals $R^1$, $R^2$, $R^3$ and $R^4$ can, independently of one another, be unsubstituted alkyl with a chain length between 8 and 24 carbon atoms, in particular between 10 and 18 carbon atoms, hydroxyalkyl having about 1 to about 4 carbon atoms, phenyl, $C_2$- to $C_{18}$-alkenyl, $C_7$- to $C_{24}$-aralkyl, $(C_2H_4O)_xH$, where x is from about 1 to about 3, alkyl radicals containing one or more ester groups, or cyclic quaternary ammonium salts. X is a suitable anion.

Further laundry detergent ingredients which may be present in the present invention include inorganic and/or organic builders in order to reduce the degree of hardness of the water.

These builders may be present in the laundry detergent and cleaning compositions in proportions by weight of from about 5% to about 80%. Inorganic builders include, for example, alkali metal, ammonium and alkanolammonium salts of polyphosphates, such as, for example, tripolyphosphates, pyrophosphates and glasslike polymeric metaphosphates, phosphonates, silicates, carbonates including bicarbonates and sesquicarbonates, sulfates and alumosilicates.

Examples of silicate builders are the alkali metal silicates, in particular those with an $SiO_2$:$Na_2O$ ratio between 1.6:1 and 3.2:1, and phyllosilicates, for example sodium phyllosilicates, as described in U.S. Pat. No. 4,664,839, obtainable from Clariant GmbH under the tradename SKS®. SKS-6® is a particularly preferred phyllosilicate builder.

Alumosilicate builders are particularly preferred for the present invention. These are, in particular, zeolites with the formula $Na_z[(AlO_2)_z(SiO_2)_y].xH_2O$, in which z and y are integers of at least 6, the ratio of z to y is from 1.0 to about 0.5, and x is an integer from about 15 to about 264.

Suitable ion exchangers based on alumosilicate are available commercially. These alumosilicates can be of crystalline or amorphous structure, and may be naturally occurring or else can be prepared synthetically. Processes for the preparation of ion exchangers based on alumosilicate are described in U.S. Pat. Nos. 3,985,669 and 4,605,509. Preferred ion exchangers based on synthetic crystalline alumosilicates are obtainable under the name zeolite A, zeolite P(B) (including those disclosed in EP-A-0 384 070) and zeolite X. Preference is given to alumosilicates with a particle diameter between 0.1 and 10 $\mu$m.

Suitable organic builders include polycarboxyl compounds, such as, for example, ether polycarboxylates and oxydisuccinates, as described, for example, in U.S. Pat. Nos. 3,128,287 and 3,635,830. Reference should likewise be made to "TMS/TDS" builders from U.S. Pat. No. 4,663,071.

Other suitable builders include the ether hydroxypolycarboxylates, copolymers of maleic anhydride with ethylene or vinyl methyl ether, 1,3,5-trihydroxybenzene-2,4,6-trisulfonic acid and carboxymethyloxysuccinic acid, the alkali metal, ammonium and substituted ammonium salts of polyacetic acids, such as, for example, ethylenediaminetetraacetic acid and nitrilotriacetic acid, and polycarboxylic acids, such as mellitic acid, succinic acid, oxydisuccinic acid, polymaleic acid, benzene-1,3,5-tricarboxylic acid, carboxymethyloxysuccinic acid, and the soluble salts thereof.

Important organic builders are also polycarboxylates based on acrylic acid and maleic acid, such as, for example, the Sokalan CP grades from BASF.

Builders based on citrate, e.g. citric acid and its soluble salts, in particular the sodium salt, are preferred polycarboxylic acid builders, which can also be used in granulated formulations, in particular together with zeolites and/or phyllosilicates.

Other suitable builders are the 3,3-dicarboxy-4-oxa-1,6-hexanedioates and the related compounds which are disclosed in U.S. Pat. No. 4,566,984.

If builders based on phosphorus can be used and in particular if soap bars for washing by hand are to be formulated, it is possible to use various alkali metal phosphates, such as, for example, sodium tripolyphosphate, sodium pyrophosphate and sodium orthophosphate. It is likewise possible to use phosphonate builders, such as ethane-1-hydroxy-1,1-diphosphonate and other known phosphonates as are disclosed, for example, in U.S. Pat. Nos. 3,159,581, 3,213,030, 3,422,021, 3,400,148 and 3,422,137.

The laundry detergents and laundry treatment compositions according to the invention can comprise customary auxiliaries or other materials which enhance the cleaning action, serve to treat or care for the textile material to be washed or change the performance properties of the detergent composition.

Suitable auxiliaries include the substances given in U.S. Pat. No. 3,936,537, for example enzymes, in particular proteases, lipases, cellulases and amylases, mannanases, enzyme stabilizers, foam boosters, foam limiters, antitarnish and/or anticorrosion agents, suspension agents, dyes, fillers, optical brighteners, disinfectants, alkalis, hydrotropic compounds, antioxidants, perfumes, solvents, solubilizers, antiredeposition agents, dispersants, processing auxiliaries, softeners, antistatic auxiliaries and soil release polymers, such as, for example, the TexCare grades/Clariant, the Repel-O-Tex grades/Rhodia or Sokalan SR-100/BASF.

The laundry detergents and cleaning compositions according to the invention comprising dye-transfer-inhibiting dye fixatives can additionally also comprise the known and commercially available dye transfer inhibitors.

Examples of these dye transfer inhibitors are polyamine N-oxides, such as, for example, poly-(4-vinylpyridine N-oxide), e.g. Chromabond S-400, ISP; polyvinylpyrrolidone, e.g. Sokalan HP 50/BASF and copolymers of N-vinylpyrrolidone with N-vinylimidazole and optionally other monomers.

A significant disadvantage of the dye transfer inhibitors commercially available hitherto is that they not only bind the dye detached from the textiles and present in the wash liquor, but additionally can also remove dyes from the textiles and thus promote fading of the washed colored fabric.

As a result of the combination with the dye-transfer-inhibiting dye fixatives, it is possible not only to improve the dye-transfer-inhibiting effect of the known dye transfer inhibitors, but it is also possible to counter the fading of the colored fabric caused by these products.

The detergent compositions of the present invention can optionally comprise one or more conventional bleaches, and also bleach activators, bleach catalysts and suitable stabilizers. In general, it must be ensured that the bleaches used are compatible with the cleaning composition ingredients. Conventional test methods, such as, for example, determination of the bleaching activity of the ready formulated cleaning composition as a function of the storage time can be used for this purpose.

The peroxy acid can either be a free peroxy acid, or a combination of an inorganic persalt, for example sodium perborate or sodium percarbonate and an organic peroxy acid precursor, which is converted to a peroxy acid if the combination of the persalt and the peroxy acid precursor is dissolved in water. The organic peroxy acid precursors are often referred to in the prior art as bleach activators. Examples of suitable organic peroxy acids are disclosed in U.S. Pat. Nos. 4,374,035, 4,681,592, 4,634,551, 4,686,063, 4,606,838 and U.S. Pat. No. 4,671,891.

Examples of compositions which are suitable for bleaching laundry and which comprise perborate bleaches and activators are described in U.S. Pat. Nos. 4,412,934, 4,536,314, 4,681,695 and U.S. Pat. No. 4,539,130.

Examples of peroxy acids which are preferred for the use in this invention include peroxydodecanedioic acid (DPDA), the nonylamide of peroxysuccinic acid (NAPSA), the nonylamide of peroxyadipic acid (NAPAA) and decyldiperoxysuccinic acid (DDPSA).

In the laundry detergents and laundry treatment compositions according to the invention, particular preference is given to using bleaching systems based on a persalt, such as perborates or percarbonates with the bleach activator tetraacetylethylenediamine (TAED).

It is known that many of the abovementioned bleaches whose purpose is the oxidative destruction of colored soilings, also cause damage to the textile dyes of brightly colored textiles.

The use of the dye-transfer-inhibiting dye fixatives can reduce the harmful effect of these bleaches on the textile dyes.

The dye fixatives described can also be used in commercially available fabric softeners for household use. These essentially comprise softening components, softeners, emulsifiers, perfumes, dyes and electrolytes, and are adjusted to an acidic pH below 7, preferably between 3 and 5.

The softening components used are quaternary ammonium salts of the type

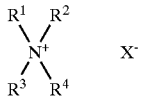

in which $R^1$=$C_8$–$C_{24}$ n- or iso-alkyl, preferably $C_{10}$–$C_{18}$ n-alkyl $R^2$=$C_1$–$C_4$-alkyl, preferably methyl $R^3$=$R^1$ or $R^2$ $R^4$=$R^2$ or hydroxyethyl or hydroxypropyl or oligomers thereof $X^-$=bromide, chloride, iodide, methosulfate, acetate, propionate, lactate.

Examples thereof are distearyldimethylammonium chloride, ditallow-alkyldimethylammonium chloride, ditallow-alkylmethylhydroxypropylammonium chloride, cetyltrimethylammonium chloride and also the corresponding benzyl derivatives, such as, for example, dodecyldimethylbenzylammonium chloride. Cyclic quaternary ammonium salts, such as, for example, alkylmorpholine derivatives, can likewise be used.

Moreover, in addition to the quaternary ammonium compounds, it is also possible to use imidazolinium compounds (1) and imidazoline derivatives (2)

(1)

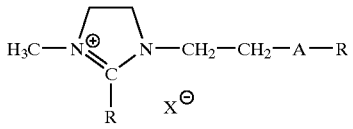

(2)

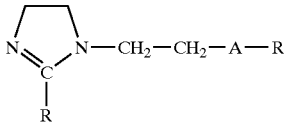

in which

R=$C_8$–$C_{24}$ n- or iso-alkyl, preferably $C_{10}$–$C_{18}$ n-alkyl

X=bromide, chloride, iodide, methosulfate

A=—NH—CO—, —CO—NH—, —O—CO—, —CO—O—.

A particularly preferred class of compound is the ester quats. These are reaction products of alkanolamines and fatty acids, which are subsequently quaternized with customary alkylating or hydroxyalkylating agents.

Preferred alkanolamines are compounds according to the formula

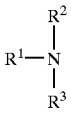

where $R^1$=$C_1$–$C_3$ hydroxyalkyl, preferably hydroxyethyl and $R^2$, $R^3$=$R^1$ or $C_1$–$C_3$ alkyl, preferably methyl.

Particular preference is given to triethanolamine and methyldiethanolamine.

Further particularly preferred starting materials for ester quats are aminoglycerol derivatives, such as, for example, dimethylaminopropanediol.

Alkylating or hydroxyalkylating agents are alkyl halides, preferably methyl chloride, dimethyl sulfate, ethylene oxide and propylene oxide.

Examples of ester quats are compounds of the formulae:

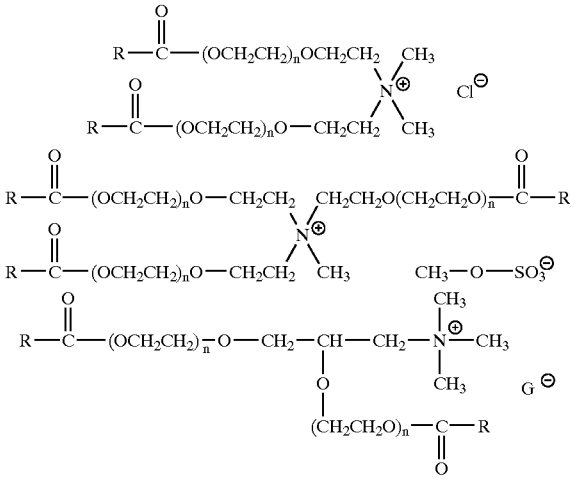

where R—C—O is derived from $C_8$–$C_{24}$-fatty acids which may be saturated or unsaturated. Examples thereof are caproic acid, caprylic acid, hydrogenated or nonhydrogenated or only partially hydrogenated tallow fatty acids, stearic acid, oleic acid, linolenic acid, behenic acid, palmitostearic acid, myristic acid and elaidic acid. n is in the range from 0 to 10, preferably 0 to 3, particularly preferably 0 to 1.

Further preferred fabric softener raw materials with which the dye fixatives can be combined are amido-amines based, for example, on dialkyltriamines and long-chain fatty acids, and also the oxyethylates or quaternized variants thereof. These compounds have the following structure:

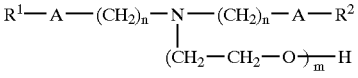

in which $R^1$ and $R^2$ independently of one another are $C_8$–$C_{24}$ n- or iso-alkyl, preferably $C_{10}$–$C_{18}$ n-alkyl, A is —CO—NH— or —NH—CO—, n is 1–3, preferably 2, m is 1–5, preferably 2–4.

Through quaternization of the tertiary amino group it is additionally possible to introduce a radical $R^3$, which can be $C_1$–$C_4$-alkyl, preferably methyl, and a counterion X, which may be chloride, bromide, iodide or methyl sulfate. Amidoamino oxyethylates or quaternized secondary products thereof are supplied under the tradenames ®Varisoft 510, ®Varisoft 512, ®Rewopal V 3340 and ®Rewoquat W 222 LM.

The preferred use concentrations of the dye fixatives in the fabric softener formulations correspond to those given for detergent formulations.

EXAMPLES

Examples of the dye-transfer-inhibiting dye fixatives used in the laundry detergents according to the invention are:

Example 1

Reaction Product of Diethylenetriamine with Dicyanodiamide and Amidosulfuric Acid.

Example 2

Reaction Product of Dicyanodiamide with Formaldehyde and Ammonium Chloride.

Example 3

Reaction Product of Dimethylaminopropylamine with Epichlorohydrin.

The dye-transfer-inhibiting dye fixatives were investigated in combination with standard detergents on various colored fabrics with regard to their color-retaining effect. The test for a dye-transfer-inhibiting effect was carried out at the same time.

For this, 300 ppm of the dye fixative were in each case added to a wash liquor comprising 6 g/l of a phosphate-free or a phosphate-containing test detergent powder, without the addition of bleach (composition see tables 1 and 3) and with the addition of bleach (composition see tables 2 and 4), and a colored cotton fabric was washed together with a white cotton fabric. A washing experiment with a liquid detergent was also carried out.

The fabrics were then rinsed with clear water and dried and the dL, da, db values were determined, which gives the color differences delta E. For comparison, the fabrics were washed with the test detergents without the addition of the dye fixatives. The washing conditions are given in table 3. A total of five washing cycles were carried out.

The values obtained on the white fabric after the first wash serve to quantify the dye-transfer-inhibiting effect.

The values measured on the colored fabric quantify the attained color retention. To compare the color-retaining effect of the dye fixatives, the average dE value obtained for five different colored fabrics was calculated.

TABLE 1

| Phosphate-free standard test detergent powder IEC-A. | |
|---|---|
| Linear alkylbenzenesulfonate ($C_{average}$ = 11.5) | 11.0% |
| $C_{12-18}$-alcohol * $EO_7$ | 5.90% |
| Soap (65% $C_{12-18}$, 35% $C_{20-22}$) | 4.10% |
| Zeolite A | 36.80% |
| Sodium carbonate | 13.40% |
| Na salt of an acrylic acid and maleic acid copolymer (Sokalan CP5 ®) | 5.90% |
| Sodium silicate ($SiO_2$:$NaO_2$ = 3.32:1) | 3.80% |
| Carboxymethylcellulose | 1.50% |
| Phosphonate (Dequest 2066 ®) | 3.50% |
| Stilbene brightener | 0.30% |
| Foam inhibitor (Dow Corning DC2-4248S ®) | 5.00% |
| Sodium sulfate | 8.40% |
| Protease (Savinase 8.0 ®) | 0.40% |

TABLE 2

| Phosphate-free standard test detergent powder IEC-A with bleach | |
|---|---|
| Linear alkylbenzenesulfonate ($C_{average}$ = 11.5) | 8.80% |
| $C_{12-18}$-alcohol * $EO_7$ | 4.72% |
| Soap (65% $C_{12-18}$, 35% $C_{20-22}$) | 3.28% |
| Zeolite A | 29.44% |
| Sodium carbonate | 10.72% |
| Na salt of an acrylic acid and maleic acid copolymer (Sokalan CP5 ®) | 4.72% |
| Sodium silicate ($SiO_2$:$NaO_2$ = 3.32:1) | 3.04% |
| Carboxymethylcellulose | 1.20% |
| Phosphonate (Dequest 2066 ®) | 2.80% |
| Stilbene brightener | 0.24% |
| Foam inhibitor (Dow Corning DC2-4248S ®) | 4.00% |
| Sodium sulfate | 6.72% |
| Protease (Savinase 8.0 ®) | 0.32% |
| TAED (Peractive P ®) | 5.00% |
| Sodium percarbonate | 15.00% |

TABLE 3

| Phosphate-containing standard test detergent powder IEC-B | |
|---|---|
| Linear alkylbenzenesulfonate ($C_{average}$ = 11.5) | 8.00% |
| $C_{12-18}$-alcohol * $EO_{14}$ | 2.90% |
| Soap (13–25% $C_{12-16}$, 74–87% $C_{18-22}$) | 3.50% |
| Sodium tripolyphosphate | 43.70% |
| Sodium silicate ($SiO_2$:$NaO_2$ = 3.3:1) | 7.50% |
| Magnesium silicate | 1.90% |
| Carboxymethylcellulose | 1.25% |
| EDTA | 0.25% |
| Stilbene brightener | 0.25% |
| Sodium sulfate | 21.00% |
| Water | 9.75% |

TABLE 4

| Phosphate-containing standard test detergent powder IEC-B with bleach | |
|---|---|
| Linear alkylbenzenesulfonate ($C_{average}$ = 11.5) | 6.40% |
| $C_{12-18}$-alcohol * $EO_{14}$ | 2.30% |
| Soap (13–25% $C_{12-16}$, 74–87% $C_{18-22}$) | 2.80% |
| Sodium tripolyphosphate | 35.00% |
| Sodium silicate ($SiO_2$:$NaO_2$ = 3.3:1) | 6.00% |
| Magnesium silicate | 1.50% |
| Carboxymethylcellulose | 1.00% |
| EDTA | 0.20% |
| Stilbene brightener | 0.20% |
| Sodium sulfate | 16.80% |
| Water | 7.80% |
| TAED (Peractive P ®) | 5.00% |
| Sodium percarbonate | 15.00% |

TABLE 5

| Liquid detergent | |
|---|---|
| $C_{14}$/$C_{15}$-Oxo alcohol polyglycol ether with 8 EO (Genapol OA-080 ®) | 12.0% |
| Fatty acid mixture (Prifac 7976 ®) | 14.0% |
| Potassium hydroxide (85% strength) | 2.6% |
| Triethanolamine | 2.0% |
| 1,2-propylene glycol | 5.0% |
| Water | 35.4% |
| Trisodium citrate 2-hydrate | 5.0% |
| Secondary alkanesulfonate (Hostapur SAS 60 ®) | 17.0% |
| Phosphonate (Dequest 2066 ®) | 4.0% |
| Ethanol | 3.0% |

TABLE 6

| Washing conditions | |
|---|---|
| Washing machine: | Linitest |
| Detergent concentration: | 6 g/l |
| Additive concentration: | 300 ppm |
| Water hardness: | 15° dH |
| Liquor ratio: | 1:40 |
| Washing temperature: | 60° C. |
| Washing time: | 30 min |

Tables 7 to 11 give the average delta E values which were obtained on red, blue, green, violet and black colored fabrics. The lower these values, the better the color retention attained with the dye fixatives in the detergents according to the invention.

TABLE 7

| Color-retaining effect in combination with the phosphate-free test detergent powder IEC-A. | |
|---|---|
| Washing powder/additive | Ødelta E values Color differences relative to the unwashed fabric after five washes |
| IEC-A without additive | 7.6 |
| +Ex. 1 | 5.3 |
| +Ex. 2 | 3.9 |
| +Ex. 3 | 4.7 |

TABLE 8

| Color-retaining action in combination with the phosphate-free test detergent powder IEC-A with bleach additive | |
|---|---|
| Washing powder/additive | Ødelta E values Color differences relative to the unwashed fabric after five washes |
| IEC-A without additive | 7.4 |
| +Ex. 1 | 6.4 |
| +Ex. 2 | 4.6 |
| +Ex. 3 | 5.5 |

TABLE 9

| Color-retaining action in combination with the phosphate-containing washing powder IEC-B | |
|---|---|
| Washing powder/additive | Ødelta E values Color differences relative to the unwashed fabric after five washes |
| IEC-B without additive | 6.1 |
| +Ex. 1 | 4.9 |
| +Ex. 2 | 3.9 |
| +Ex. 3 | 2.9 |

TABLE 10

| Color-retaining action in combination with the phosphate-containing washing powder IEC-B with bleach additive | |
|---|---|
| Washing powder/additive | Ødelta E values Color differences relative to the unwashed fabric after five washes |
| IEC-B without additive | 6.6 |
| +Ex. 1 | 5.6 |
| +Ex. 2 | 4.5 |
| +Ex. 3 | 3.6 |

TABLE 11

| Color-retaining action in combination with a liquid detergent | |
|---|---|
| Washing liquid/additive | Ødelta E values Color differences relative to the unwashed fabric after five washes |
| Liquid detergent without additive | 3.9 |
| +Ex. 1 | 2.9 |

TABLE 11-continued

| Color-retaining action in combination with a liquid detergent | |
|---|---|
| Washing liquid/additive | Ødelta E values Color differences relative to the unwashed fabric after five washes |
| +Ex. 2 | 2.0 |
| +Ex. 3 | 0.6 |

The examples below illustrate the dye-transfer-inhibiting action of the detergents according to the invention comprising the dye-transfer-inhibiting dye fixatives on the white fabrics washed together with the colored fabrics.

The lower the measured dE values of the white fabric, the lower the staining thereof by the transferred dye.

TABLE 12

| Dye-transfer-inhibiting action in combination with the phosphate-free test detergent powder IEC-A on a violet test fabric. | |
|---|---|
| Washing powder/additive | delta E values of the white test fabric washed together with violet colored fabric after one wash |
| IEC-A without additive | 36.9 |
| +Ex. 1 | 12.7 |
| +Ex. 2 | 15.2 |
| +Ex. 3 | 14.6 |

TABLE 13

| Dye-transfer-inhibiting action in combination with the phosphate-free test detergent powder IEC-A on blue test fabric. | |
|---|---|
| Washing powder/additive | delta E values of the white test fabric washed together with blue colored fabric after one wash |
| IEC-A without additive | 32.6 |
| +Ex. 1 | 8.7 |
| +Ex. 2 | 18.9 |
| +Ex. 3 | 14.7 |

TABLE 14

| Dye-transfer-inhibiting action of example 1 in combination with the phosphate-free test detergent powder IEC-A on other colored test fabrics. | | | |
|---|---|---|---|
| Washing | delta E values of the white test fabric washed together with other colored fabrics after one wash. | | |
| powder/additive | black | green | red |
| IEC-A without additive | 35.1 | 22.0 | 37.5 |
| +Ex. 1 | 15.1 | 10.9 | 28.3 |

What is claimed is:

1. A laundry detergent comprising a surfactant and dye-transfer-inhibiting dye fixatives where these dye-transfer-inhibiting dye fixatives are obtained by reacting a) polyamines with cyanamides and amidosulfuric acid or b) cyanamides with aldehydes and ammonium salts.

2. The laundry detergent as claimed in claim 1, further comprising a surfactant selected from the group consisting of anionic surfactants, nonionic surfactants, cationic surfactants, and mixtures thereof.

3. The laundry detergent as claimed in claim 1, further comprising dye transfer inhibitors selected from the group consisting of polyamine N-oxides, polyvinylpyrrolidone, copolymers of N-vinylpyrrolidone with N-vinylimidazole, and mixtures thereof.

4. The laundry detergent as claimed in claim 2, wherein said surfactant is a cationic surfactant.

5. The laundry detergent as claimed in claim 1, further comprising soil release polymers.

6. The laundry detergent as claimed in claim 1, further comprising cellulases.

7. The laundry detergent as claimed in claim 1, further comprising bleaches.

8. A method for inhibiting dye transfer in a washing liquor, said method comprising adding to the washing liquor a laundry detergent comprising a surfactant and dye-transfer-inhibiting dye fixative obtained by reacting a) polyamines with cyanamides and amidosulfuric acid, or b) cyanamides with aldehydes and ammonium salts.

9. The method of claim 8, laundry detergent is in a form selected from the group consisting of pulverulent, granular, paste, gel, and liquid.

10. The method of claim 8 wherein the dye-transfer-inhibiting dye fixative ranges from 0.1 to 10 weight percent of the laundry detergent.

11. The laundry detergent as claimed in claim 1, further comprising inorganic builder, organic builder, or mixtures thereof.

* * * * *